US006996959B2

(12) United States Patent
Sting

(10) Patent No.: US 6,996,959 B2
(45) Date of Patent: Feb. 14, 2006

(54) ENVELOPE-FILLING STATION FOR MAIL-PROCESSING SYSTEMS

(75) Inventor: Martin Sting, Bad Vilbel (DE)

(73) Assignee: Pitney Bowes Deutschland GmbH, Heppenheim (DE)

( * ) Notice: Subject to any disclaimer, the term of this patent is extended or adjusted under 35 U.S.C. 154(b) by 0 days.

(21) Appl. No.: 10/756,940

(22) Filed: Jan. 14, 2004

(65) Prior Publication Data

US 2004/0201158 A1 Oct. 14, 2004

(51) Int. Cl.
*B65B 43/26* (2006.01)

(52) U.S. Cl. ..... 53/569; 53/251; 53/284.3; 270/58.06

(58) Field of Classification Search ..... 53/251, 53/284.3, 564, 569; 270/58.06
See application file for complete search history.

(56) References Cited

U.S. PATENT DOCUMENTS 4,333,300 A * 6/1982 Russell ..... 53/569
5,125,214 A * 6/1992 Orsinger et al. ..... 53/460
5,180,154 A * 1/1993 Malick ..... 271/2
5,203,551 A 4/1993 Lowell et al. ..... 270/59
5,447,015 A * 9/1995 Belec et al. ..... 53/492
5,581,972 A * 12/1996 Antonelli ..... 53/75
5,597,156 A * 1/1997 Claassen ..... 271/225
5,667,214 A * 9/1997 Belec et al. ..... 271/225
5,924,265 A * 7/1999 Auerbach ..... 53/460
5,950,399 A * 9/1999 Viens et al. ..... 53/381.6
6,102,391 A * 8/2000 Malick et al. ..... 271/225
6,164,046 A * 12/2000 Werner et al. ..... 53/569
6,817,608 B1 * 11/2004 Sloan et al. ..... 271/216

FOREIGN PATENT DOCUMENTS

DE 10015756 10/2001

* cited by examiner

*Primary Examiner*—Louis K. Huynh
*Assistant Examiner*—Thanh Truong
(74) *Attorney, Agent, or Firm*—Michael J. Cummings; Charles R Malandra, Jr.; Angelo N. Chaclas

(57) ABSTRACT

An envelope-filling station for mail-processing systems. The station includes an enclosure feeder for transporting enclosures to an inserting arrangement pushing enclosures into envelopes in the same direction as the enclosure feeder. An envelope supply is positioned parallel to the enclosure feeding device. Envelopes are diagonally transported from the envelope supply to the inserting arrangement by an intermediate transport. A movable stop, in an active state, holds an envelope received in position for insertion of enclosures. When the movable stop is changed to an inactive state the filled envelope can be conveyed away from the envelope-filing station. The movable stop has a further intermediate stop position in which the stop is moved back, by a comparatively small distance in relation to the push-in movement, such that, under the driving frictional action of the intermediate envelope-conveying device, the filled envelope comes free of the push-in arrangement in the push-in direction.

15 Claims, 4 Drawing Sheets

ENVELOPE-FILLING STATION FOR MAIL-PROCESSING SYSTEMS

BACKGROUND OF THE INVENTION

The invention pertains to an envelope-filling station for mail-processing systems, whereby this envelope-filling station belongs to a general design as known from German Patent Application 100 15 756 A1, for example.

The known envelope-filling station of this type provides that an envelope-conveying device has, starting from an envelope-separating arrangement, a course that is parallel to a conveying path for the conveying of enclosures or sets of enclosures, and exhibits at its end aligning means in the form of stops that can be adjusted to the envelope format, in such a way that an intermediate envelope-conveying device, which, in the known envelope-filling station, has a conveying direction that is perpendicular to the conveying direction of the conveying path for the enclosures, receives an envelope that has been conveyed by the envelope-conveying device in a precisely aligned state and transports it by means of gripping between, on the one hand, an envelope-conveying belt that is guided over an envelope table, and on the other, a roller strip that can be lowered onto the envelope-conveying belt, upstream of a push-in arrangement of the envelope-filling station, again in a precise position, and stops there so that the filling of the envelopes with enclosures or sets of enclosures can subsequently continue, after the mentioned roller strip has been raised. Afterwards, the roller strip is again lowered onto the filled envelope and the envelope-conveying belt is put into operation in such a way that the filled envelope is conveyed away.

One can see that with this inherently very advantageous design for aligning the envelope during the conveying sections in the region of the envelope-conveying device, considerable mechanical effort and control effort has to be conducted in the region of the intermediate envelope-conveying device running perpendicular to that, as well as upstream of the push-in station.

Up to now, this effort has been accepted particularly because the arrangement of the envelope-conveying device parallel to and alongside the conveying path for the enclosures or sets of enclosures placed at about the same level as this conveying path has proven to be advantageous for the adjusting, monitoring and general operation by an operator, since during setup, along with the envelope-separating arrangement and the envelope-conveying device the operator can also oversee and access the push-in arrangement and the feeding device for the enclosures or sets of enclosures.

In certain designs of push-in arrangements, considerable effort in terms of the adjusting and control of the working cycles of the push-in arrangement on the one hand and on the other, the intermediate envelope-conveying device and conveying devices for conveying the filled envelopes away, also arises from the fact that the conveying away of the filled envelopes is reliably to take place only if the push-in parts or push-in fingers of the push-in arrangement have been withdrawn from the region of the envelope that has been filled and is to be conveyed away.

SUMMARY OF THE INVENTION

The task of the present invention is thus to form an envelope-filling station of the general design briefly described above, in such a way that while retaining the favorable positioning possibilities for the operator, the effort for aligning the envelope to be filled on the path between the envelope-separating arrangement and the push-in arrangement is simplified, and at the same time a very rapid clearing of the filled envelope from the region of the push-in arrangement is achieved in such a way that trouble-free operation results even at a work speed of, for example, 12,000 working cycles per hour and more.

The invention is based on the realization that with coupling or gripping of a conveyed envelope that varies section by section and is of varying strength relative to the particular envelope-conveying devices, and through provision of an angled course of a conveying section, an aligning of the envelope relative to two coordinate axes can take place simultaneously in a single operation upstream of the push-in arrangement, without a precise preliminary alignment having had to take place previously on intermediate sections of the envelope conveying, and that by this precise aligning of the envelope to be filled upstream of the push-in arrangement by means of the angled conveying section, a departing step of the filled envelope away from the push-in station can additionally be realized with little technical effort before the conveying away of the envelope is carried out.

This permits a simplification of the matching of the working cycles of the intermediate envelope-conveying arrangement, the aligning means, the push-in arrangement and the means for conveying away the filled envelope. In addition, the principle stated here permits the use of certain very advantageous designs for push-in arrangements.

DESCRIPTION OF THE DRAWINGS

Several embodiments are described in more detail below with the aid of the drawing. The following are shown.

DETAILED DESCRIPTION

Figure 1:
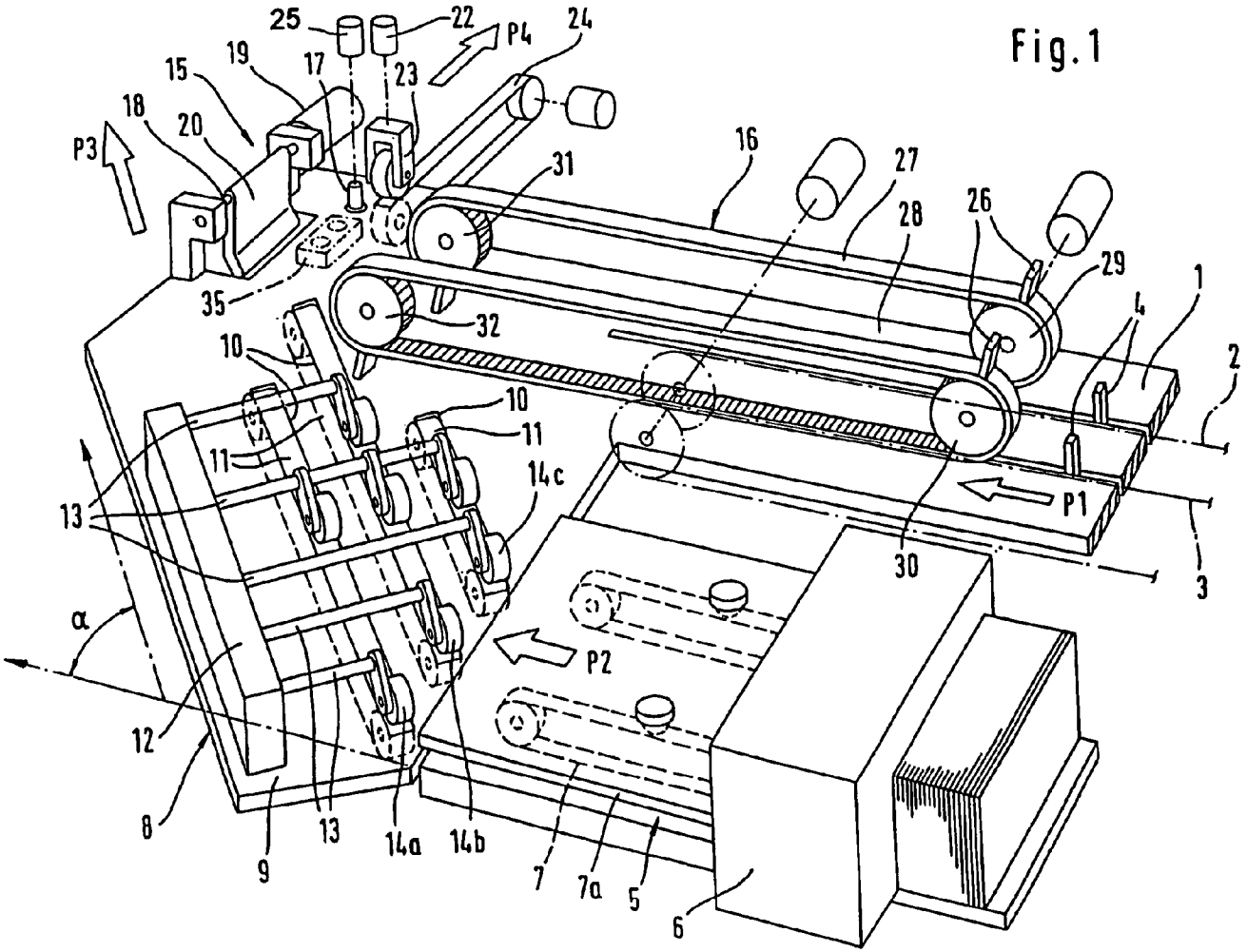
FIG. 1 is a schematic perspective view of an envelope-filling station of the type suggested here.
Figure 2:
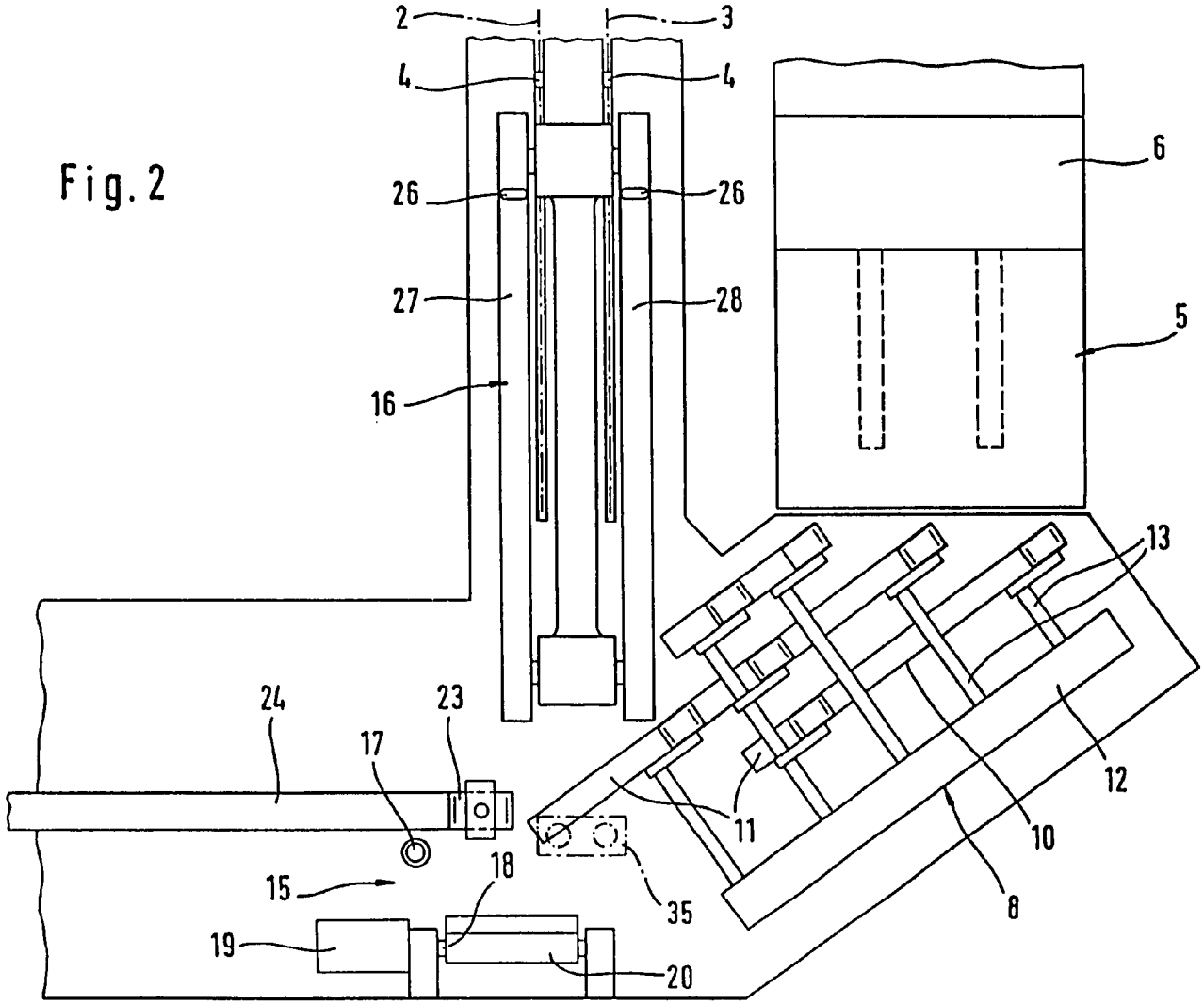
FIG. 2 is a top view in schematic representation of the envelope-filling station according to FIG. 1.
Figure 3:
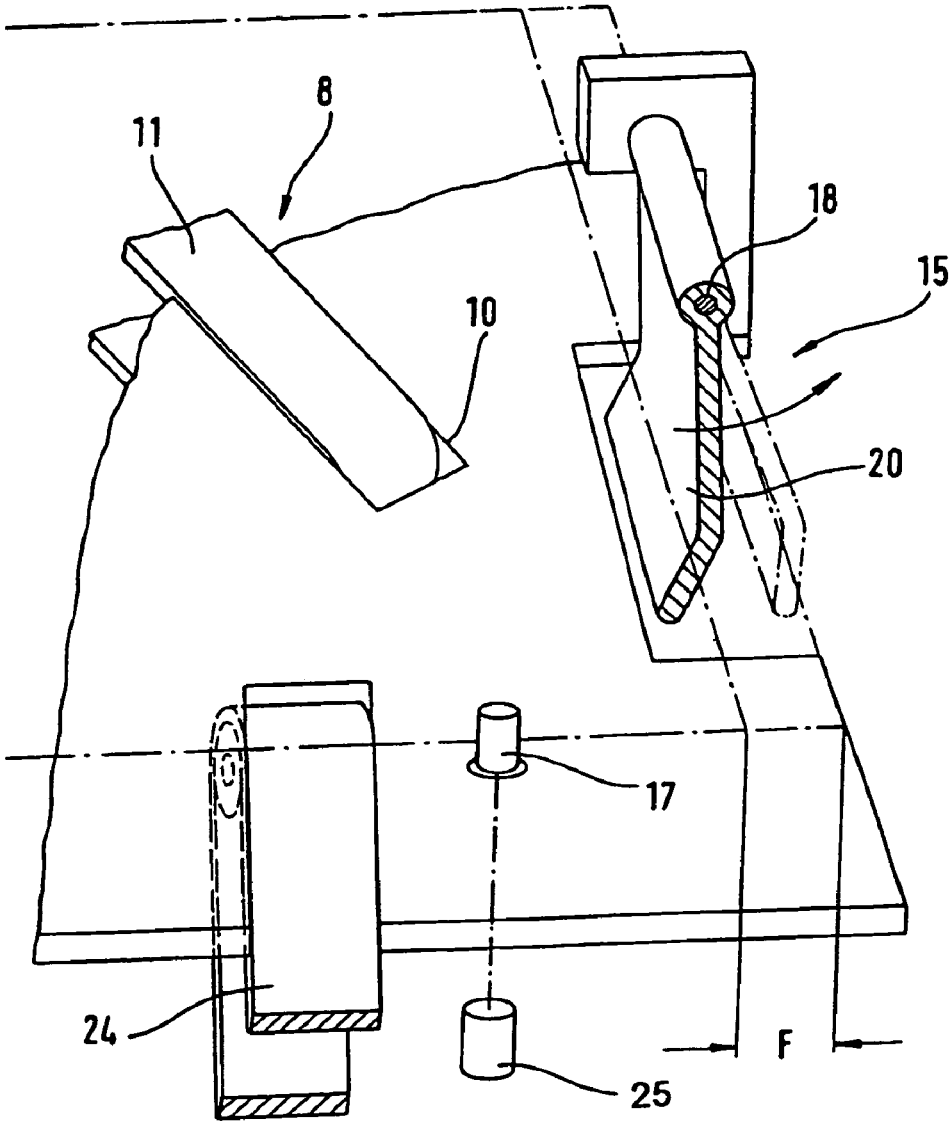
FIG. 3 is a perspective detail representation of the part of the intermediate envelope-conveying device that works with the angled stop arrangement.

Underneath a conveying belt plate 1, the envelope-filling station according to FIGS. 1 through 3 contains endless, circulating conveying chains 2 and 3 that are guided over driven or free-running chain wheels and that are provided in the generally known way with conveying fingers 4 so that pairs of adjacent conveying fingers, which rise over the conveying path plate 1 from the particular top strand of the conveying chains 2 and 3, define enclosure compartments into which enclosures or sets of enclosures can be placed into the enclosure compartments along the course of the feeding device formed by conveying chains 2 and 3, and can be moved towards the envelope-filling station in the direction of arrow P1. The actuation of conveying chains 2 and 3 can work intermittently or continuously.

Extending parallel to the feeding device for the enclosures or sets of enclosures and alongside the feeding device is an envelope-conveying device that is generally designated by 5 in FIG. 1. The envelope-conveying device 5 connects to an envelope-separating arrangement 6 in which from an envelope pack consisting of envelopes inserted standing on edge, a sequence of separated envelopes is created in a way known in the art. The envelope-conveying device 5 accepts this sequence of separated envelopes and transports them lying flat essentially in a horizontal plane to a group of endless, circulating driving belts 7 that are guided over track rollers and driven rollers. The envelope-conveying device 5 receives the envelopes from the envelope-separating arrangement 6 in a state in which the envelope flaps are already open. In the first section of the envelope-conveying device 5, the conveyed envelopes are still gripped relatively tightly between the top strands of the driving belts 7 and pressing rollers or pressing rolls prestressed against them from above, while with further progress of the envelopes in the direction of arrow P2 shown in FIG. 1, this gripping becomes looser, which can be achieved by progressively less prestress by the pressing rolls, for example.

Finally, an envelope conveyed by the envelope-conveying device 5 arrives by its leading edge, which lies opposite the envelope opening, in the region of an intermediate envelope-conveying device that is generally designated by 8. The intermediate envelope-conveying device 8 contains a intermediate envelope-conveying table 9 with a top that is placed approximately at or somewhat below the level of the feeding path plate 1, whereby provided in the intermediate envelope-conveying table 9 are elongated cutouts 10 through which pass, slightly above the level of the intermediate envelope-conveying table 9, the top strands of the endless, circulating conveying belts 11, which are guided over track rollers and driven rollers. The angle of the central longitudinal axis of the cutouts 10 versus the conveying direction of the envelope-conveying device 5 is designated by $\alpha$ in FIG. 1, and lies in the range between 15° and 75°, whereby an angle of 40° to 50° is preferred.

Fastened on the surface of the intermediate envelope-conveying table 9 is a bearing web 12, which extends parallel to the elongated cutouts 10 and from which bearing axles 13 protrude horizontally above the intermediate envelope-conveying table 9 and in an orientation perpendicular to the course of the elongated cutouts 10. Mounted on these bearing axles are spring-loaded pressing rollers that interact with the top strands of the circulating driving belts 11.

It can be seen in FIG. 1 that a set of spring-loaded pressing rolls 14*a*, 14*b* and 14*c* is mounted on each of the associated bearing axles 13 in such a way that, interacting with the top strands of the driving belts 11, this set of pressing rollers simultaneously grasps and tightly grips the leading edge of an envelope conveyed from the envelope-conveying device 5 and, because of the now-looser gripping of the envelope in the end phase of the conveying by the envelope-conveying device 5, conveys the envelope along the intermediate envelope-conveying device 8 in a translational movement at an angle and in a direction corresponding to the angle $\alpha$, without the enveloping experiencing a rotating movement.

Interacting with each of the top strands of the driving belts 11 are additional abutment rollers, which are mounted on associated bearing axles 13 and are downstream of abutment rollers 14*a*, 14*b* and 14*c*, and the number and/or prestress force of which decreases in the direction of the associated driving belts 11 with increasing progress in the conveying direction of the intermediate envelope-conveying device, corresponding to arrow P3, in such a way that at the beginning of the conveying by the intermediate envelope-conveying device 8, the gripping of a conveyed envelope between the driving belts 11 and the abutment rollers 14 is comparatively tight, but is relatively loose towards the end of the intermediate envelope-conveying device 8, particularly in the region in which an envelope is conveyed by the intermediate envelope-conveying device 8 against an angled stop arrangement 15, which when switched to the active state, precisely aligns the conveyed envelope upstream of a push-in arrangement 16, which collects enclosures or set of enclosures from the feeding device and pushes them into the conveyed, opened, for example, by compressed air jets, envelope. Due to the slight gripping or the loose coupling between the conveyed envelope and the abutment rollers 14 that interact with the driving belts 11, during the aligning the envelope is able to carry out an aligning movement in its plane under the effect of striking the angled stop arrangement.

The angled stop arrangement 15 contains a stop pin 17 that can be lowered into an inactive position or raised into an active position above the level of the intermediate envelope-conveying table 9 by means of drive 25, and a stopping straightedge 20, which is hook-like in cross section and is oriented perpendicular to the conveying direction of the feeding device and perpendicular to the push-in direction of the push-in arrangement 16, and which is fastened to a pivot shaft 18 that is supported above the level of the intermediate envelope-conveying table 9. The pivot shaft can be pivoted between two positions by means of a rotary drive, for example, by means of a rotary magnet 19. In the first position, which is designated as the active position, the main part of the stopping straightedge, which is placed on the pivot shaft 18, is approximately vertical and assumes a position in which the precise alignment of the conveyed envelope upstream of the push-in arrangement 16 takes place in interaction with the stop pin 17, which has been switched to the active state.

In the second pivot position of the stopping straightedge 20, the latter has been pivoted on the pivot shaft 18 somewhat in the clockwise direction relative to the representation of FIG. 1, so that the main part of the stopping straightedge, which is placed on the pivot shaft 18, runs downward at an angle from the pivot shaft, while the lower, hook-like projection of the stopping straightedge runs approximately vertically downward and realizes an intermediate stop position, which can also be seen in FIG. 3. When the stopping straightedge 20 reaches this position and the stop pin 17 remains switched to the active state by the drive 25, then with the driving belts 11 having been put into operation again or having remained continuously in operation, a filled envelope, following the stopping straightedge 20 that has been switched back, is withdrawn by a distance F from the push-in arrangement 16 in such a way that the push-in parts of the latter reliably come free of the filled envelope before the latter is conveyed away.

Details of the functioning of the angled stop arrangement as just described can be seen in FIGS. 2 and 3.

As soon as the envelope that has been conveyed by the intermediate envelope-conveying device and aligned by it in interaction with the angled stop arrangement is filled and has been withdrawn relative to the push-in arrangement through creation of an intermediate stop position of the angled stop arrangement, the angled stop arrangement in its entirety is switched to the inactive state, which takes place by raising the stop pin 17 by means of the drive 25 in the embodiment according to FIG. 1, or by lowering the stop pin below the level of the intermediate envelope-conveying table 9 in the embodiment according to FIG. 3. Now, by means of a drive 22, a pressing roller 23 is lowered in the direction of the top strand of an endless, circulating driving belt 24, as a result of which the filled envelope is grasped by the envelope-advancing device containing the pressing rollers 23 and driving belts 24, and is conveyed away in a direction perpendicular to the push-in direction corresponding to arrow P4.

Embodiments are conceivable in which, in a modification of the embodiment according to FIG. 1, in order to switch the angled stop arrangement 15 to the inactive state, not only is the stop pin 17 raised or lowered, but the stopping straightedge 20 is also completely pivoted away in such a way that after an envelope has been filled and withdrawn relative to the push-in arrangement through creation of the intermediate stop position, the filled envelope is then advanced by the intermediate envelope-conveying device 8 in the direction of arrow P3, for example.

In the embodiment shown in FIG. 1, the push-in arrangement contains endless push-in belts 27 and 28, which are parallel to each other, provided with push-in fingers 26, circulate over the feeding path plate 1 of the feeding device, and in particular, have the form of toothed belts and are placed over driven rollers 29 and 30 as well as free-running rollers 31 and 32. When they are located in the region of the bottom strand of the push-in belts 27 and 28, adjacent sets of push-in fingers 26 receive enclosures or sets of enclosures from the conveying fingers 4 of the conveying chains 2 and 3, for which purpose the push-in belts 27 and 28 move at a greater circulating speed than the conveying speed of the conveying chains 2 and 3 in such a way that at a suitable match in timing a set of push-in fingers 26 overtakes a set of conveying fingers 4 of the conveying chains 2 and 3 and thereby lifts the enclosures or sets of enclosures from this set of conveying fingers and conveys them in the direction of a readied open envelope. Once the push-in fingers 26 have pushed an enclosure or set of enclosures into the readied open envelope that has been aligned by the angled stop arrangement 15 upstream of the push-in arrangement 16, then the switchover of the angled stop arrangement into the intermediate stop position takes place with the stopping straightedge 20 pivoted back somewhat, along with a corresponding moving up of the filled envelope in a direction corresponding to the push-in direction of the push-in arrangement 16. Because of the free space that is created towards the opening of the filled envelope, this means that the push-in fingers 26 can easily run upward around the free-running rollers 31 and 32 to the top strand of the push-in belts 27 and 28 without the push-in fingers rubbing against the edges of the opening of the filled envelope.

However, even if, unlike the embodiment according to FIG. 1, the push-in arrangement contains push-in fingers that can move back and forth parallel to the conveying direction of the conveying path and receive enclosures or sets of enclosures from the conveying path, and that are moved over a base plate and are supported on a pivot lever that is actuated in an operating stroke and a return stroke, the withdrawing of the filled envelope from the push-in arrangement following the first alignment and filling of the envelope also proves to be very expedient, since an advancement by the advancing device can take place without delay after the filling operation, without having to wait for the return stroke of the push-in fingers, which at first starts relatively slowly from the dead point of the pivoting movement. This simplifies the adjusting of the envelope-filling station, and in certain cases allows an increase in operating speed.

It can be seen from the top view of FIG. 2 that in the region upstream of the push-in arrangement 16, where the envelope conveyed by the intermediate envelope-conveying device 8 is first aligned at the angled stop arrangement 15 upstream of the push-in arrangement 16, there is provided above this region a pressing arrangement 35, which can optionally be moved into an active position or lifted from this active position and the details of which are not specifically shown in the drawing. In the embodiment shown, this pressing arrangement 35 contains in cages two spherical rolling bodies that can rotate freely within these cages and that have a certain vertical play. With the interaction of one of the driving belts 11 of the intermediate envelope-conveying device, the cages, together with the spherical rolling bodies, can be lowered in the direction of an envelope delivered and aligned just upstream of the intermediate envelope-conveying device 8, in such a way that the spherical rolling bodies together with one of the driving belts 11 reliably convey the envelope into the angular space between the stop parts of the angled stop arrangement and assist the alignment. After that, the pressing arrangement is lifted off during the filling of the envelope and is thus moved into an inactive position in order, when the stopping straightedge 20 has pivoted back by the distance F in order to withdraw the filled envelope, then to be lowered back onto the filled envelope in such a way that, with the interaction of a driving belt 11 of the intermediate envelope-conveying device 8 and the pressing arrangement 35, the envelope is reliably moved back by the distance F. Once that has taken place, the stop pin 17 of the angled stop arrangement 15 is switched by means of the drive 25 to the inactive state (i.e., it is raised or lowered below the level of the intermediate envelope-conveying table 9) and the advancing device is set into action by lowering the roller 23 by means of the drive 22, and the filled envelope is conveyed away. The person skilled in the art will recognize that a suitably controlled drive, a solenoid, for example, is assigned to the pressing arrangement 35, but that it has been left out of the drawing for the sake of simplicity.

In order to achieve that the envelopes arriving from the separating device 6 with an open envelope flap are conveyed in the horizontal direction according to arrow P2 in FIG. 1 inside the envelope-conveying device 5 tightly gripped at first, and then shortly before their transfer to the intermediate envelope-conveying device 8 are advanced only with low forces so that following the engagement of the abutment rollers 14*a*, 14*b* and 14*c*, the intermediate envelope-conveying device conveys the envelope parallel to the device itself in the direction of arrow P3, the envelope-conveying device preferably exhibits endless, circulating conveying belts 7 that are arranged parallel to each other and, in an end section that is located upstream relative to the conveying direction, abutment rollers or abutment rolls, each of which interacts with the top strand of the conveying belts and butts against the top side of the envelope. However, in the above-mentioned end section of the envelope-conveying device, provided then as abutment means that interact with the top strand of the conveying belts and are positioned against the top side of the envelope are either a housing-mounted abutment plate 7*a*, as is indicated in FIG. 1, or spherical rolling bodies that are guided in cages of a housing-mounted abutment plate.

Another embodiment of the envelope-conveying device, not shown in the drawing, provides that it contains endless, perforated conveying belts running over vacuum chambers, whereby the vacuum from the end section adjacent to the intermediate envelope-conveying device can be adjusted in such a way, or the number of adjacent perforated conveying belts in this end section is reduced in such a way, that in the above-mentioned end section the conveyed envelope can be moved with a movement component transverse to the conveying direction of the envelope-conveying device as soon as the intermediate envelope-conveying device engages the envelope.

Figure 5:
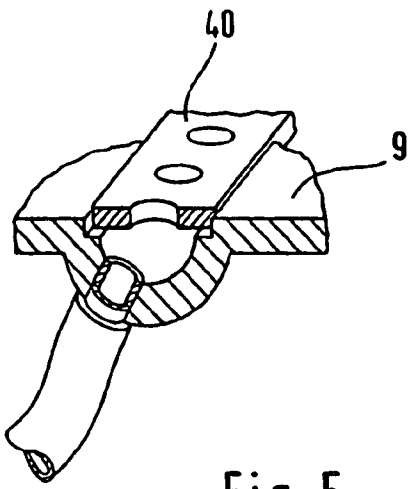
FIG. 5 is a perspective and partial section view of conveying means of the intermediate envelope-conveying device according to FIG. 4.
Figure 4:
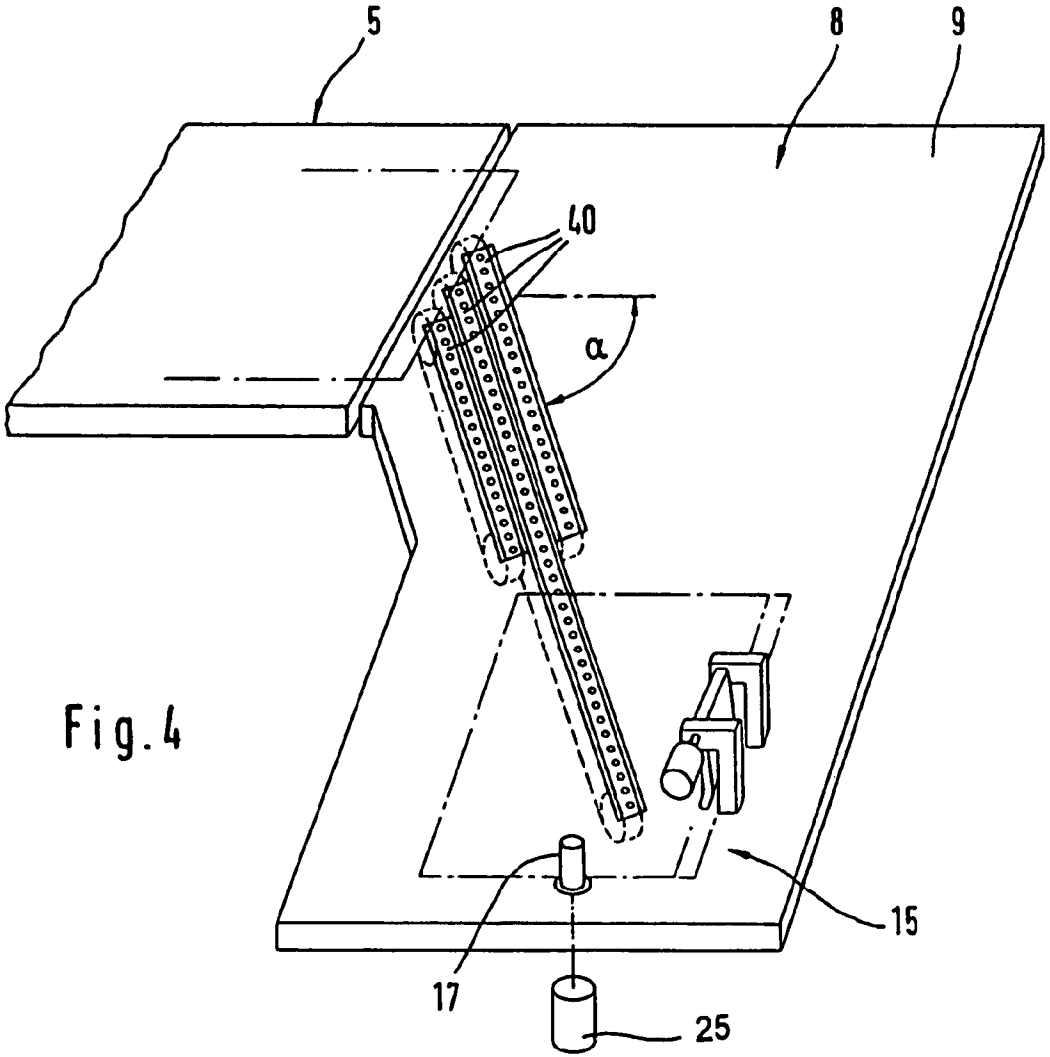
FIG. 4 is a schematic perspective partial view of the envelope-conveying device and the intermediate envelope-conveying device that is modified versus the design according to FIGS. 1 and 2.

In a way similar to that described above, the intermediate envelope-conveying device can contain, as is shown in FIGS. 4 and 5, endless, perforated conveying belts 40 that run over vacuum chambers, whereby the vacuum from vacuum chambers located in the region near the angled stop arrangement can be adjusted in such a way, and/or the number of adjacent perforated conveying belts 40 in this region is reduced in such a way, that, overcoming relatively low frictional forces, the conveyed envelope can be displaced in its plane relative to the intermediate envelope-conveying device for the purpose of alignment at the angled stop arrangement. For the purpose of withdrawing the filled envelope from the push-in station, during the approach and presence of an envelope at the angled stop arrangement as well as during the switching of the angled stop arrangement into the intermediate stop position, the intermediate envelope-conveying device preferably remains switched on, and is controlled accordingly.

Since the switching of the angled stop arrangement into the inactive position in the shown embodiments provides only the lowering or raising of the stop pin 17 while the stop straightedge 20 remains in the position taken through production of the intermediate stop position, even if the intermediate conveying device is kept in continuous operation, the filled envelope is removed by the advancing device in the direction of arrow P4, without being turned by the continuously running intermediate envelope-conveying device.

What is claimed is:

1. An envelope-filling station for mail-processing systems, the envelope-filling station comprising;

a feeding device for horizontally feeding enclosures along a conveying path to a push-in arrangement, a push-in direction of which is in the conveying direction of the conveying path;

an envelope-separating arrangement for separating envelopes from an envelope stack and for producing a sequence of separated envelopes;

an envelope-conveying device which is arranged parallel to the conveying path, alongside the latter, and is intended for receiving the sequence of separated envelopes and for transferring the same to an intermediate envelope-conveying device wherein the intermediate envelope-conveying device transports the envelopes received from the envelope-conveying device, to the push-in arrangement; and wherein, the intermediate envelope-conveying device has a conveying direction running at an angle in the range of from 15° to 75° to a conveying direction of the envelope-conveying device and, in a section which is adjacent to the push-in arrangement, the intermediate envelope-conveying device is designed such that a conveyed envelope can be displaced in its plane relative to the intermediate envelope-conveying device;

wherein, provided at the end of the intermediate envelope-conveying device, in the position opposite the push-in arrangement, is an angled stop arrangement, the angled stop arrangement having a first part and a second part, wherein the first part can be switched to an active or inactive state and against which, in its active position, the envelope is positioned for receiving an enclosure from the push-in arrangement, and is restrained from moving perpendicular to the push-in direction;

wherein, once the envelope has been filled with the enclosure the angled stop arrangement can then be switched to the inactive state such that the filled envelope can be conveyed away from the envelope-filing station by an envelope-advancing device; and wherein, once the angled stop arrangement has been switched to the active state and before being switched to the inactive state, the second part of the angled stop arrangement is moved into an intermediate stop position in which the second part, against which the envelope edge which is perpendicular to the push-in direction of the push-in arrangement is positioned, is moved back, by a comparatively small distance in relation to the push-in movement, in the push-in direction, and wherein the second part of the angled stop arrangement is movable independently of the first part to achieve the intermediate stop position.

2. An envelope-filling station according to claim 1 wherein the push-in arrangement contains push-in fingers which can be moved back and forth parallel to the conveying direction of the conveying path, and receives the enclosures or sets of enclosures from the conveying path and has an operating stroke which is dimensioned to cooperate with the second part of the angled stop arrangement to insert enclosures in the envelope.

3. An envelope-conveying station according to claim 1 wherein the push-in arrangement contains push-in belts which are parallel to one another, are provided with push-in fingers and circulate over the feeding device.

4. Envelope-filling station according to claim 1 wherein the angled stop part, against which of the envelope is positioned, is formed by a stopping straightedge which can be switched over between two pivoting positions and can be pivoted about a horizontal pivot axis running perpendicularly to the push-in direction of the push-in arrangement, one pivoting position of the stopping straightedge, in which the latter is located at a greater distance from the push-in arrangement, corresponding to the intermediate stop position of the angled stopping arrangement.

5. An envelope-filling station according to claim 4 wherein the drive of the angled stopping arrangement contains a rotary drive, in particular a rotary magnet, acting on the pivot shaft of the stopping straightedge.

6. An envelope-filling station according to claim 4 wherein the pivot axis of the stopping straightedge is located above or beneath the level of the horizontal plane determined by an intermediate envelope-conveying table.

7. An envelope-filling station according to claim 1 wherein the envelope-conveying device contains endless, circulating conveying belts, which are arranged parallel to one another, and, in a section which is located upstream of the abovementioned end section, as seen in the conveying direction abutment rollers which each interact with the top strand of the conveying belts and butt against the top side of the envelope.

8. An envelope-filling station according to claim 1 wherein, in the abovementioned end section, the envelope-conveying device has, as abutment means which interact with the top strand of the conveying belts and are positioned against the top side of the envelope, a housing-mounted abutment plate or spherical rolling bodies which are guided in cages of a housing-mounted abutment plate.

9. An envelope-filling station according to claim 1 wherein the intermediate envelope-conveying device contains endless, perforated conveying belts running over vacuum chambers, in which case it is possible to adjust the vacuum by vacuum chambers located in the abovementioned end section, and/or there is a reduction in the number of adjacent perforated conveying belts in the end section, such that, in the abovementioned end section, the conveyed envelope can be moved with the movement component transverse to the conveying direction of the envelope-conveying device.

10. An envelope-filling station according to claim 1 wherein the intermediate envelope-conveying device contains endless, circulating conveying belts, which are arranged parallel to one another, and, in the region which is adjacent to the envelope-conveying device, abutment rollers which each interact with the top strand of said conveying belts and of which the axes of rotation are oriented orthogonally to the conveying direction of the intermediate envelope-conveying device.

11. An envelope-filling station according to claim 10 wherein in a region which is located closer to the end of the top strands of the conveying belts than to the start thereof, the intermediate envelope-conveying device has, as abutment means which interact with the top strand of the conveying belts and are positioned against the top side of the envelopes, spherical rolling bodies which are guided in cages of a support which can be raised and lowered.

12. An envelope-filling station according to claim 1 wherein the intermediate envelope-conveying device contains endless, perforated conveying belts running over vacuum chambers, in which case it is possible to adjust the vacuum from the region of vacuum chambers located in the vicinity of the angled stop arrangement, and/or there is a reduction in the number of adjacent perforated conveying belts in this region, such that the conveyed envelope can be displaced in its plane relative to the intermediate envelope-conveying device, frictional forces being overcome in the process.

13. An envelope-filling station according to claim 1 wherein the intermediate envelope-conveying device is controlled such that its conveying means are kept in operation even when the conveyed envelope has run up against the angled stop arrangement.

14. An envelope-filling station according to claim 1 wherein the envelope-advancing device has a conveying direction which runs transversely to the push-in direction of the push-in arrangement.

15. An envelope-filling station according to claim 1 wherein the angle of the conveying direction of the intermediate envelope-conveying device is in a range from 40° to 50°.

* * * * *